US005268045A

United States Patent [19]

Clare

[11] Patent Number: 5,268,045

[45] Date of Patent: Dec. 7, 1993

[54] METHOD FOR PROVIDING METALLURGICALLY BONDED THERMALLY SPRAYED COATINGS

[75] Inventor: James H. Clare, Reynoldsburg, Ohio

[73] Assignee: John F. Wolpert, Jeffersonville, Ind.

[21] Appl. No.: 891,279

[22] Filed: May 29, 1992

[51] Int. Cl.[5] ..... C25D 5/38; C25D 5/50

[52] U.S. Cl. ..... 148/518; 148/525; 204/144.5; 427/456

[58] Field of Search ..... 148/512, 518, 525; 427/456; 204/144.5

[56] References Cited

U.S. PATENT DOCUMENTS

| | | | |
|---|---|---|---|
| 4,246,323 | 1/1981 | Bornstein et al. | 427/456 |
| 4,328,257 | 5/1982 | Muehlberger et al. | 427/423 |
| 4,557,808 | 12/1985 | Strunck et al. | 204/144.5 |
| 4,933,239 | 6/1990 | Olson et al. | 427/456 |

OTHER PUBLICATIONS

Clare et al., "Thermal Spray Coatings", Metals Handbook, 9th ed., vol. 5, ASM, Metals Park, Ohio 1982, pp. 361-374.

Maitland et al., "Selective Plating", Metals Handbook, 9th ed., vol. 5, ASM, Metals Park, Ohio 1982, pp. 292-299.

*Primary Examiner*—George Wyszomierski

*Attorney, Agent, or Firm*—Frank H. Foster

[57] ABSTRACT

Metallurgical bonded thermally sprayed coatings of exceptional bond strength are provided by a metal surface, prior to thermal spray coating, being electrochemically cleaned, or more desirably being electrochemically cleaned and electrochemically metallized, prior to overlaying with a thermal spray deposited metal coating with after depositing the thermal spray coating proceeding with a post heat treatment.

11 Claims, 1 Drawing Sheet

METHOD FOR PROVIDING METALLURGICALLY BONDED THERMALLY SPRAYED COATINGS

TECHNICAL FIELD

This invention relates to a method for providing metallurgically bonded thermally sprayed coatings. More particularly, it relates to a method wherein a metallic surface, prior to being thermal spray coated, is electrochemically cleaned, or more desirably electrochemically cleaned and electrochemically metallized, prior to overlaying with a thermal spray deposited metal coating.

BACKGROUND ART

Thermal spray coating is appropriate terminology to describe generically a group of well-known processes for depositing metallic, non-metallic or mixed non-metallic/metallic coatings. Common to thermal spray coating processes are that they require a heat source, a propelling means and a feed material to produce the coating system and also that the material to be deposited is used as is or converted to a very fine particulate state, desirably atomized, and in this particulate molten state at very high velocity propelled upon the target being coated. These processes, sometimes known as "metallizing", include Flame Spray (powder and wire), Plasma-Arc Spray (vacuum and atmospheric), Electric-Arc Spray, Detonation Spray and a recent technology development called High Velocity Oxygen Fuel (HVOF) spray. Metal and ceramic materials can be applied or 37 sprayed" from rod or wire stock and from powdered material. In the form of wire or rod, material is fed into the flame axially from the rear, where it is melted. The molten material is stripped from the end of the wire or rod and atomized by a high velocity stream of compressed air or another gas which then propels the material onto a prepared substrate or workpiece. In the electric-arc process two wires are electrically charged by a D.C. power supply. The wires are then feed into electrode tubes where arcing occurs between the wires. The heat of the arc produces molten metal that is then atomized by a compressed air stream and propelled onto a substrate to form a coating. The electric-arc process can only be used with electrically conductive materials. In powder form the material is metered, by a powder feeder or hopper, into a compressed air or gas stream which suspends and delivers the material to the flame. In the flame it is heated to a molten or semi-molten state then propelled to the work piece, where upon impact a bond is produced.

As molten or semi-molten particles impinge upon the substrate, one or more of several possible bonding mechanisms allow a coating to be built up. Mechanical bonding occurs when the particles "Splat" on the substrate and interlock with a roughened surface and/or other deposited particles forming a coating. With some combinations of substrates and coating materials localized micro-welding and/or diffusion alloying can occur. With some thermal spray coating systems, some bonding may also occur by means of Van der Waals forces. Analogous to this bonding would be the mutual attraction and cohesion which occurs between any two clean surfaces in intimate contact, e.g., the reflective coatings on mirrors, two optical flats or two gage blocks. Dependent upon the particular thermal spray coating process, coating material and substrate composition, any or all of these bonding mechanisms may come into play. However, for some applications and especially for thermal spray metallic coatings on metal targets or underlying metallic substrates, a bonding mechanism of metallurgical bonding is desirable. A metallurgical bond can be defined as adherence of a coating to the base material characterized by diffusion, alloying, or intermolecular or intergranular attraction at the interface between the sprayed particles and the base or other underlying material and usually is a stronger bond than a mechanical bond.

Among the thermal spray coating systems there are two, namely Vacuum Plasma Spray and Flame Sprayed and Fused processes providing products, which apparently can exhibit metallurgical bonding throughout at the interface of the thermally sprayed coating and its underlying base or substrate.

Vacuum plasma spraying (VPS) of high technology coatings is widely accepted throughout the world as a viable means for applying metallurgically bonded coatings. This process has proven to be an economical means for depositing most metallic and MCrAlY (multiple element alloys) coating materials used in the gas turbine industry. The high integrity coating produced by this process are usually pore free and metallurgically bonded.

Vacuum plasma spraying in inert atmosphere offers several unique advantages over conventional plasma spraying in inert atmosphere at atmosphere pressure.

To deposit a coating with optimum physical properties the spray material must maintain its original composition and metallurgical structure. These conditions are rarely achieved when depositing coatings in atmosphere conditions. In vacuum plasma spraying, the bond strength is increased because of higher substrate temperatures usually about 1600° F., allowing the coating to partiality diffuse into the base material.

Spray deposition efficiency of the powder feed material can be increased because of increased particle dwell time in the longer heating zone of the VPS plasma. The coating produced by VPS are subjected to minimal changes in chemistry and metallurgy due to the chambers inert atmosphere.

The use of a plasma transfer arc process in vacuum is essential for achieving a metallurgical bond of the coating to the substrate. The plasma stream is electrically conductive, a secondary or transfer arc can be generated from the gun to the substrate provided the substrate is conductive. The substrate is negatively charged by a secondary D.C. power supply (approximately 300 amperes), this allows the energy of the arc to remove or sputter clean the substrate. This cleaning action creates a metallurgically clean surface and promotes bonding of the coating. A process of this type is described in U.S. Pat. No. 4,328,257. Post coating diffusion bonding of the VPS coating is normally accomplished in a vacuum furnace at 1950° F. to 2050° F. This heat treat operation completes the metallurgical bonding of the coating.

Normal operating procedures for VPS require the spray chamber be pumped down to approximately 400 μm of Hg and then backfilled with inert gas (Argon) to 300 torr. Once the system has been sufficiently purged to achieve an acceptable inert atmosphere, the plasma spray operation is activated and the chamber pressure adjusted to the desired level for spraying. The entire spray operation is accomplished in a soft vacuum (approximately 50 torr). It should also be noted that the optimum spraying conditions will vary with the chemistry and particle size of each spray material. These variables are similar to conventional plasma spraying. Due to the complexity of low pressure spraying the entire process is best controlled by a computer, assuring complete reproducibility and homogeneity throughout the coating cycle.

Metallurgical bonding of thermally sprayed coatings also is achievable by a process called Flame Spray and Fuse. This process is a modification of the powder-flame spray method. The materials used for the coating are self-fluxing, fusible materials which require post-spray heat treatment. In general, these materials are nickel or cobalt base alloys which employ boron, phosphorous, or silicon (singly or in combination) as melt-point depressants and fluxing agents. In practice, parts are prepared and coated as in other thermal spray processes. Fusing is accomplished using one of several techniques; flame or torch, induction, or in vacuum, inert or hydrogen furnaces. These alloys generally fuse between 1850° and 2150° F. depending on composition. Reducing atmosphere flames should be used to insure a clean, well bonded coating.

In vacuum and hydrogen furnaces the coating may have a tendency to "wick" or run onto adjacent areas. Several paint-on stop-off materials are commercially available to confine the coating. It is recommended that test parts be fused, whenever the geometry, coating alloy, or lot of material is changed, to establish the minimum and maximum fusing temperatures. (The fusing temperature is known to vary slightly from lot-to-lot of spray material.) On vertical surfaces coating material may sag or run off if the fusing temperature is exceeded by more than a few degrees. Excessive porosity and non-uniform bonding are usually indicative of insufficient heating. Spray and fuse coatings are widely used in applications where excessive wear is a problem. These alloys generally exhibit good resistance to wear and have been successfully used in the oil industry for sucker rod, in agriculture for plowshares, etc. In most applications fusible alloys make possible the use of less expensive substrate materials. Coating hardness can be as high as $R_c$ 65. Some powder manufacturers offer these alloys with tungsten carbide or chrome carbide particles blended to increase resistance to wear from abrasion, fretting, and erosion. As mentioned earlier, these coatings are fully dense and exhibit metallurgical bonds. Grinding is recommended for finishing fused coatings because of the inherent high hardness. Use of spray and fuse coatings is limited to substrate materials which can tolerate the 1850° to 2150° F. of fusing temperatures. Fusing temperatures may also alter the heat treatment of some alloys. However, the coating will usually withstand reheat treating the substrate.

Thermal Spray devices used for most atmospheric coating applications can be hand held or machine mounted. Specially designed guns are commonly mounted on lathe compounds to spray cylindrical parts. Large flat parts are usually sprayed with guns mounted to two axis positioners such as those used by the welding industry. Complex parts requiring three or more axes of freedom can now be coated using commercially available, multiple-axis robots, and automated computer controlled systems. Using these techniques, geometries ranging from simple cylinders to complex air foils are being coated.

Thermal Spray coating is an effective, efficient means for altering surface characteristics of most materials. Thermally sprayed coatings enhance wear resistance, provide thermal barriers, and prevent hot corrosion-/erosion of critical assemblies. The technology is essential to the aircraft engine and stationary gas turbine engine industry and is finding increasing applications in automotive, marine and industrial markets. There are many variables involved when producing thermally sprayed coatings, e.g., coating feed material, material flow rate, heat source control, substrate material and condition, and surface finish, etc. Coatings produced by this process are utilized throughout the world in almost every industry. Currently, the thermal spray process is widely used by all aircraft engine manufacturers for improving performance of civilian and military aircraft turbine engines. The aircraft repair and overhaul industry also utilizes thermal spray coatings for a variety of restoration and upgrade applications.

For additional background information on thermal spray coatings, reference is made to *Metals Handbook*, Vol. 5, *Surface Cleaning, Finishing and Coating*, 9th ed., American Society for Metals, Metals Park, Ohio, (1982) and particularly therein pages 361–374, "Thermal Spray Coatings", co-authored by J. H. Clare and D. E. Crawmer, with as much of pages 361–374 as necessary to complete this application's disclosure incorporated herein by this reference thereto.

As mentioned earlier, the condition of the substrate onto which the thermal sprayed coating is deposited is of great importance. Substrate surface cleanliness is of great importance in all thermal spray processes in order to ensure good bonding. As apparent from the just-mentioned *Metals Handbook* article entitled "Thermal Spray Coatings" and the portion of the article, pages 366–368, conventional surface preparation of the substrate surface is not taught to involve electrochemical cleaning thereof prior to thermal spray coating.

There exists in the coating technology a process called Selective Plating and also referred to as electrochemical metallizing. This electrochemical coating process, for example is described in an article entitled "Selective Plating", co-authored by D. W. Maitland and M. J. Deitsch, *Metals Handbook*, Vol 5, *Surface Cleaning, Finishing and Coating*, 9th ed., American Society for Metals, Metals Park, Ohio, 1982, pp. 292–299, with as much of this article as necessary to complete this application's disclosure incorporated herein by this reference thereto. Near the top of page 296 are taught the use of preparatory solutions to remove surface contaminants prior to selective plating. Briefly selective plating (i.e. electrochemical metallizing) is a molecular process in which the metal or alloy is being deposited molecule by molecule from a concentrated electrolyte bonding solution without using an immersion tank. The plating or bonding solution is in an absorbent material covering a portable anode or stylus which is connected to a special direct current power pack having the cathode lead of the power pack connected to the workpiece (i.e. the metallic surface to be coated). The stylus is moved in relation to the workpiece with the bonding solution there between and at the requisite voltage and current metal is deposited from the plating solution by contact of the solution-saturated anode with an area of the workpiece. In some ways selective plating is a process similar to a combination of arc welding and electroplating. The phenomenon involved creates a high level of adhesion to a workpiece surface which has been properly cleaned and activated. Because of high current levels employed, the metallic deposits are very dense, generally without voids and pore sites.

BRIEF DISCLOSURE OF INVENTION

The method of the invention for providing a metallurgically bonded thermally sprayed coating comprises:

a) electrochemically cleaning a superficially clean and degreased metallic surface of a workpiece to be coated;

b) thermal spray coating of the metallic surface, which has received said electrochemical cleaning, with a coating composition containing a metal or metals to provide on said metallic surface an overlay coating containing the metal or metals; and c) post heat treating at an elevated temperature for a time with said elevated temperature and said time effective to diffuse said metal or metals contained in said overlay coating into said metallic surface.

In a more preferred embodiment of the invention's process, the method for providing a metallurgically bonded thermally sprayed coating comprises:

a) electrochemically cleaning a superficially clean and degreased metallic surface of a workpiece to be coated;

b) electrochemically activating and metallizing the metallic surface, which has received said electrochemical cleaning, with a strike coating of at least one metal;

c) thermal spray coating of the strike coating with a coating composition containing a metal or metals to provide an overlay coating of the metal or metals on the strike coating; and d) post heat treating at an elevated temperature and time with said elevated temperature and time effective to diffuse said metal or metals into said strike coating.

In each of the above two method embodiments, the overlay coating of a metal or metals by the thermal spray coating step effectively bonds with a bond strength significantly greater than the bond strength of an overlay coated deposited by the same thermal spray coating directly on the superficially cleaned and degreased metallic surface of the workpiece. Additionally, the overlay coating of the metal or metals deposited by the thermal spray coating step, after the post heating step, has the metal or metals diffused into said metallic surface of the workpiece in the above first stated process of the invention and has the metal or metals diffused into the strike coating on the metallic surface of the workpiece and in comparison with no observed diffusion of the metal or metals into the metallic surface of the workpiece in a comparative process of an overlay coating of the metal or metals deposited by the same thermal spray process directly on the metallic surface of the workpiece which metallic surface was not subjected to the electrochemical cleaning prior to the thermal spray coating and which thermal spray coating had received the same post heat treating.

Additional features and understanding of the invention will become apparent from the detailed description, which follows, when taken in conjunction with the drawings wherein:

BRIEF DESCRIPTION OF DRAWINGS

In FIGS. 1 and 2 the drawings are not to scale and the same reference numeral in each represents the same component or element.

Figure 1:
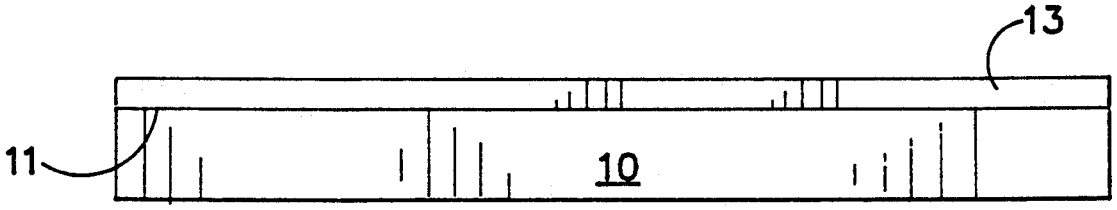
FIG. 1 presents in schematic format a sectional view of a product resulting from practice of a process embodiment of the invention, which process includes electrochemical cleaning.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

DETAILED DESCRIPTION

In the drawings there are shown in schematic format sectional views of products of practices of two embodiments of the method of the invention. In general 10 represents the workpiece or target, usually of a metal or a metal alloy, although not necessarily a metal or metals so long as workpiece 10 includes a metallic surface 11, which has been electrochemically cleaned. The thermal spray coating deposit is represented in general by 13, while in FIG. 2 there also is shown the activated surface/electrochemical metallized strike coating 12.

To practice the method of the invention, depending on the purpose for coating, one employs a workpiece, generally in its entirety or principally composed of a metal or metals (e.g. metal alloy or composite) capable of adequately withstanding the subsequent processing steps of the invention's process and providing a metallic surface for subsequent electrochemical cleaning. A large variety of metal workpieces, such as shafts, spindles, piping, tubes, bearings, crankshafts, roller faces and journals, hydraulic rams, dryer drums, pump plungers, sleeves, impeller blades, turbine blades and vanes, roller races, fly wheels, etc. are known to be capable of thermal spray coating as well as the various metals and alloys that comprise these respective workpieces. The useful metals and alloys include ferrous, non-ferrous, and noble metals as well as their various alloys used in one or more of the aforementioned workpieces. For illustrative purposes and to mention only a few of the various materials of these workpieces and various thermal spray coatings known to be applied thereto for such purposes as size reclamation, improved anti-fretting and wear properties, for providing purposely abradable wear properties for clearance control or mating with another part, for alteration of hardness, ductility or other property including high-temperature and oxidation resistance, corrosion resistance, etc., the art teaches workpiece materials and thermal spray coating materials of carbon steel, stainless steel, nickel-chromium steels, nickel, bronze, aluminum, zinc, cobalt and nickel base alloys, and the like. The surface to be coated is made free, generally by mechanical means such as grit blasting, brushing, grinding, and/or chemicals, etc. of loose and adherent dirt, debris, paint coatings, rust, oxides and general tarnish and the like so as to be provided in a superficially clean state. Surface contaminants such as residual protective oils, light oils, fingerprints and the like then are removed by employing known degreasing techniques such as immersion in various vapor and liquid solvents, including Freon TF, trichlorethylene, etc.

Thereafter, a superficially clean and degreased metallic surface of the workpiece is ready and available for electrochemical cleaning. If the metallic surface of the workpiece has not been degreased or adequately degreased as is preferred, the electrochemical cleaning step can still proceed although a longer electrochemical cleaning time is required and a preparatory solution employed in electrochemical cleaning may not be able to be recycled and will have a shorter useful life. Preferred electrochemical cleaning is essentially a reversing of the polarity of the workpiece and the stylus from that in the electrochemical metallizing step and also an employing of a preparatory aqueous solution instead of a concentrated electrolyte bonding solution employed in electrochemical metallizing. Electrochemical metallizing has been discussed in the Background section of this document and also described in the aforementioned article entitled "Selective Plating" whose teachings are incorporated by reference herein. The metallic surface to be coated is processed using a conventional manual or automated moving electrochemical metallizing stylus. The stylus can be configured to a mirror configuration of the configuration of the metallic surface subsequently to be coated. The metallic surface is electrochemically cleaned to remove surface contamination and/or oxides by gently rubbing the stylus over the metallic surface with the preparatory aqueous solution therebetween. Electrochemical cleaning is accomplished in a positive mode at approximately 0.020 to 0.030 ampere-hours per $in^2$ of the surface area to be cleaned.

The preparatory solution contains acidic- or alkaline-soluble substances or both and sometimes, as needed, wetting agents and other additives, and contains none of the metal salts, generally organo-metallic chelates, found in activating and/or bonding solutions employed for electrochemical metallizing. Usually the acidic substance is an acid such as an inorganic acid of sulfuric acid, phosphoric acid, hydrochloric acid, chromic acid, nitric acid and the like and/or an organic acid, such as lactic acid, citric acid, acetic acid, and the like. Useful alkaline-soluble substances for the preparatory solution include sodium hydroxide and the like. In general art-known aqueous compositions recognized as useful for tank electrosmoothing, electrobrightening and electropolishing of the surfaces of various metals and alloys, are useful in the electrochemical cleaning step. For illustrative example to mention a few, carbon steel can be electropolished as the anode connection in an aqueous 50%/wt. hydrochloric or 50%/wt. hydrofluoric acid solution containing a slight amount of gelatin at a temperature between 50°-105° F. (10°-40.5° C.) and a current density of a minimum of 1400 Amp./$ft^2$ with superimposed a.c. recommended; nickel and nickel alloys can be electropolished with an aqueous 70%/wt. sulfuric acid solution; copper and its alloys can be electropolished as the anode connection in a composition consisting essentially of 15%/wt. arsenic acid, 55%/wt. phosphoric acid, 3%/wt. chromic acid, and 27%/wt. water at a temperature of about 130° F. (54.4° C.) and a current density of about 500 Amp./$ft.^2$; stainless steel as an anode connection can be electropolished in a liquid composition of 75% to almost 100%/wt. phosphoric acid, balance water at an operating temperature of 150° F. (65.6° C.) and a current density of 300 Amp./$ft^2$; and the like.

Electropolishing is the reverse of electroplating whereby metal is removed rather than deposited. Thus an alternative embodiment of the invention's electrochemical cleaning step involving the therein employed preparatory solution and a moving stylus is to carry forth the electrochemical cleaning by practicing a tank electropolishing of the workpiece's metallic surface to be thermal spray coated. The electrocleaning of workpieces for conventional in-tank plating is common throughout the electroplating industry. Many electroplaters effectively clean metal parts in stationary tanks, utilizing electrolytic cleaning in alkaline solutions. This cleaning method can be used for the metallic surface electrochemical cleaning prior to the application of the thermal spray coating. The tank technique is more suited to higher production volumes of coated workpieces.

In electrochemical cleaning, the usual wetting, emulsifying and other physical and chemical actions are assisted by the solution agitation resulting from liberation of gases during electrolysis. The metallic surface to be coated is connected to act as an electrode (either cathode or anode) in the alkaline cleaning solution, through which is passed a low-voltage (6 to 12 volts) direct current of 20 or more amperes for each square foot of surface to be cleaned. When current passes through the preparatory solution, the water in the solution decomposes and liberates hydrogen on the cathode and oxygen on the anode. These gases rise to the surface of the solution and their upward movement agitates the solution and thus accelerates removal of the dirt and other particles from the metallic surface of the workpiece. This agitation of the preparatory solution in immediate contact with the soiled and/or oxidized metal surface removes the film of solution (including any still present thin layer of soil and/or oxide which it wets or is attached to) and replaces it with a film of fresh, uncontaminated preparatory solution that is ready to wet and attach itself to the next available layer of soil. Repetition of this action eventually transfers soil residue from the metal surface to the cleaning solution where it is held in temporary emulsion or suspension.

A metal component is negatively charged when it is the cathode in an electrical circuit, positively charged when it is the anode. It accordingly attracts particles with opposite charges and repels those with similar charges. Dirt particles carrying a charge like that of the component being cleaned are subject to a force tending to push them from the metal surface. Application of these principles explains an extraordinary effectiveness of electrochemical cleaning in removal of surface contaminates. The molecules of the acidic alkaline ingredients in the employed preparatory solution ionize in water solutions; that is, they split into cations (positively charged particles such as sodium ions) and anions (negatively charged particles such as hydroxide, carbonate and phosphate ions). The cations migrate to the cathode, the anions to the anode. Depending on whether their charges are positive or negative, colloids (fine particles suspended in solution) also migrate toward the cathode or anode during electrocleaning. The concentration of these particles in the solution near the metal surface also assists in the removal of contaminates.

The metallic surface to be coated can be electrochemical cleaned with direct current when it is connected as the cathode (−) in the tank electrical circuit, and with reverse current when it is connected as the anode (+).

The following gives a brief comparison of the two methods.

DIRECT-CURRENT (CATHODIC) CLEANING

The volume of hydrogen liberated at the cathode is twice that of oxygen liberated at the anode. Thus, the gas bubble's upward movement provides greater solution agitation or action to help loosen dirt from the metallic surface of the workpiece connected as the cathode. Cleaning is assisted by the fact that the negatively charged component repels negatively charged particles of dirt. A disadvantage is that the negatively charged component attract positively charged ions of copper, zinc, other metals and soaps and some colloidal materials in the cleaning solution, causing them to "plate out" as a loose smut on the metallic surface.

There exists danger that the atomic hydrogen liberated on the metallic surface may penetrate the surface and become occluded or absorbed by it. Steel becomes very brittle if this gas is not expelled. Buffered nonferrous components can be subjected to direct current for longer periods than are safe with reverse current. This is because the negative charge on the component represses the tendency of a nonferrous component to dissolve in an alkaline cleaning solution and also because the presence of hydrogen protects the nonferrous surface from the tarnishing effect of oxygen.

Direct-current cleaning is more sensitive to chromic acid contamination of the electrocleaning solution than reverse-current cleaning.

REVERSE-CURRENT (ANODIC) CLEANING

Because of the volume of oxygen liberated at the anode is half that of hydrogen liberated at the cathode, a metallic surface connected as the anode receives less scouring action from the agitation provided by the gas bubbles. This can be offset, however, by increasing the current density.

The electrochemical cleaning is assisted by the fact that the positively charged component repels positively charged particles of dirt. An advantage is that the positively charged metallic surface does not attract soaps or metal ions that usually form smut. If such deposits or carbon smuts are on the metal component, they are repelled or "unplated" from the surface. There is no danger of hydrogen embrittlement because the only gas liberated on the component is oxygen. The component surface does not occlude or absorb oxygen because the oxygen atoms are too large to penetrate the molecular structure of the component.

Nonferrous components (unlike steel) cannot be cleaned with reverse current for more than a few seconds. This is because the current increases the tendency of nonferrous components to dissolve in an alkaline cleaning solution and also because nonferrous surfaces are excessively oxidized or tarnished during prolonged exposure to oxygen. Suitable inhibitors incorporated in the electrocleaning solution can minimize or prevent this oxidation. Some authorities believe that reverse-current cleaning of nonferrous metal components (with the exception of lead, nickel and its alloys, and silver) is desirable because solution of the disturbed surface metal provides a more active base conductive to better adhesion of the electroplating.

Following the electrochemical cleaning step of the metallic surface to be coated of the workpiece it is desirable to proceed as soon as possible to the next step of the invention's process. The next step may be a thermal spray coating of the electrochemically cleaned metallic surface of the workpiece, or alternatively, and as preferred, desirably is an electrochemical activating and metallizing to provide a strike coating of at least one metal prior to proceeding with the thermal spray coating.

In the embodiment of the invention's method wherein a thermal spray coating immediately follows the step of electrochemical cleaning of the metal surface to be coated, one utilizes one or more of the thermal spray coating processes categorically termed and numbered as follows: (1) Plasma Spray (Atmospheric and Vacuum), (2) Flame Wire Spray, (3) Flame Powder Spray, (4) Electric Arc Spray, (5) High Velocity Oxygen Fuel Spray, and (6) Detonation Spray.

Figure 2:
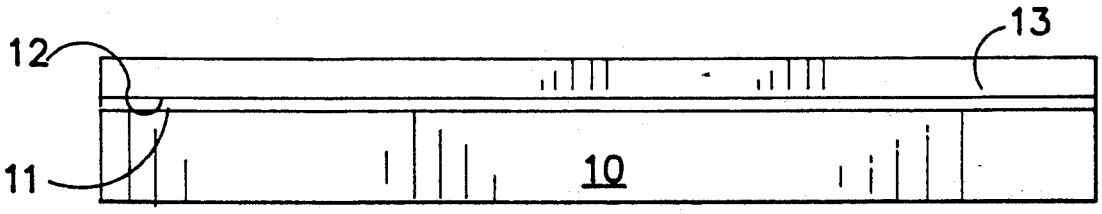
FIG. 2 presents in schematic format of a sectional view of a product resulting from practice of another process embodiment of the invention, which another process includes electrochemical cleaning and electrochemical metallizing prior to thermal spray coating.

Although not illustrated in the drawing's FIG. 1 and FIG. 2, multiple thermal spray coating steps, which may be the same or a categorically termed different multiple spray coating processes, may follow one another in a series or sequence with their deposited coatings of the next deposited overlaying the earlier deposited so as to build up a total deposited thickness (sum of the respective thicknesses of the multiple consecutively deposited overlay coatings) significantly greater in overall coating thickness than the thickness practicably depositable by a single applied respective categorically termed thermal spray coating process. Moreover the multiple consecutively deposited overlay coatings in combination form a unitary integral coating mass which is very dense and apparently without voids and pore sites. Such an application of multiple thermal spray coating steps offers significant advantages where the end purpose is dimensional build-up or configuration reshaping or preparing free-standing shapes on metallic-surfaced patterns.

As to descriptive procedures, materials, and process parameters for practicing each of the aforementioned categorically termed and numbered thermal spray coating processes, the aforementioned, incorporated by reference herein, "Thermal Spray Coating" article co-authored by J. Clare and D. Crawmer includes substantial teachings enabling one to practice each of these thermal spray coating processes and especially when taken with other knowledge publicly available as well as specific teachings included in this document and especially the specific examples herein.

Additionally, as to the thermal spray coating processes employable in the invention's method, the plasma spray process (1) by plasma-arc produces higher flame temperatures and powder particle velocities than most of the flame spray processes. This produces coatings which exhibit higher densities and higher bond strengths. Any oxide content of deposited metal coatings is inherently lower due to the use of inert plasma arc gases.

A plasma is an excited gas, considered to be a fourth state of matter, consisting of an equal ratio of free electrons and positive ions. This forms an electrically neutral "flame". A plasma-arc "gun" is a water-cooled device which has an open ended chamber in which the plasma is formed. The primary arc gas, usually argon or nitrogen, is introduced into the chamber and is ionized by the electrical discharge from a high frequency arc starter. Once initiated, the plasma can conduct currents as high as 2000 Amperes DC, with voltage potentials ranging from approximately 30 to 80 volts DC. Standard plasma guns are rated at up to 40 KW. More recent high energy guns are rated at up to 80 KW. The latter produces exit velocities in excess of MACH two. A plasma is heated by resistance to the flow of electrical current. In monatomic gases, higher temperatures are generated by simply passing more current through the plasma. To achieve even higher temperatures, secondary gases such as nitrogen, helium, and hydrogen are added to the plasma. This raises the ionization potential of the net, arc gas. In addition the enthalpy, or heat content, is increased allowing higher temperatures at lower power levels.

The power level, the pressure and flow of the arc gases, and the rate of flow of powder and carrier gas are controlled at the console of a commercially available system. The spray gun orientation and gun-to-work distance are usually preset, and the movement of the workpiece is ordinarily controlled by using automated or semi-automated equipment. Substrate temperatures can be controlled by preheating and by limiting the temperature changes during processing.

The thermal spray, termed flame spray (2) (3), utilizes combustible gases as a heat source to melt the coating material. Flame spray guns are available to spray materials in either rod, wire or powdered forms. Most flame spray guns can be operated with several combinations of gases to obtain the necessary balance of operating cost and coating properties. In general, changing the nozzle and/or air cap is all that is required to convert the gun. Acetylene, propane, Mapp gas, and oxygen-hydrogen are commonly used flame spray gases. For all practical purposes, the rod and wire guns are similar.

Flame temperatures and characteristics can be varied as a function of oxygen to gas ratios as can be seen in the following Table I.

TABLE I

OXYGEN TO FUEL GAS RATIO

| Ratio | Temperature °F. | Flame Condition | Results |
|---|---|---|---|
| 1:1 | 5400 | Carburizing | Insufficient Heat |
| 1:1 | 5400 | Reducing | Good for some metal |
| 1.1:1 | 5500 | Neutral | Recommended for general use |
| 1.1:1 | 6000 | Oxidizing | Good for some ceramics |

The flame spray process is characterized by low capital investment, high deposition rates and efficiencies, and relative ease and cost of maintenance. In general, flame sprayed coatings exhibit lower bond strengths, higher porosity, a narrow working temperature range, and higher heat transmittal to the substrate than plasma-arc and electric arc spray. Notwithstanding, the flame spray process is widely used by industry for the reclamation of worn or out-of-tolerance parts.

The thermal spray coating process termed electric-arc spray (4) utilizes metal in wire form. This process differs from the other thermal spray processes in that there is no external heat source such as gas flame or electrically induces plasma. Heating, and melting, occurs when two electrically opposed charged wires, comprising the spray material, are fed together in such a manner that a controlled arc and melting occurs at the intersection. The molten metal is atomized and propelled onto a prepared substrate by a stream of compressed air or gas.

Electric-arc spray offers several advantages over other thermal spray processes. In general this process exhibits higher bond strengths, in excess of 10,000 PSI when deposited on a grit blasted surface for some materials. Deposition rates of up to 120 pounds per hour have been achieved for some nickel base alloys. Substrate heating is lower than other processes due primarily to the absence of a flame impinging on the substrate. The electric-arc process is in most cases less expensive to operate than the other processes. Electrical power requirements are low and with few exceptions no expensive gases, such as argon, are necessary. By using dissimilar wires it is possible to deposit PSEUDO—alloys. A less expensive wear surface can be deposited using this technique. One wire, or 50% of the coating, matrix can be an inexpensive filler material.

Metal-face molds can be made using a fine spray attachment available commercially. Mold made in this way can replicate extremely fine detail. Molds have been made which re-produced the relief of lettering from a printed page.

The electric-arc process is limited to electrically conductive materials which are relatively ductile.

The thermal spray coating process termed high velocity oxygen fuel spray (5), HVOF, involves the technology of internal burning of a fuel gas in the pressure range of 75–125 pounds per square inch gage (psig). This pressurized burning produces a hot, extreme velocity exhaust jet stream. The jet stream produced is used to heat and accelerate the powder particles, which can be sprayed on a substrate to build up a coating. The powder is introduced axially and centrally into the exhaust jet. The powder being completely surrounded by the exhaust gas over a distance of 13" or more, is accelerated and heated uniformly. Particle velocities have been calculated to be about 2,500 feet/second at impact upon the substrate, causing the molten particles to deform and coalesce into all the available pore sites. This kinetic energy and momentum transfer produce a high degree of compressive strengths within the coating. The hot, extremely high velocity particles bond exceptionally well to a to-be-coated surface which has been cleaned by grit blasting. Coatings produced by this process are typically high integrity mechanical/metallurgical bond structures. Metallurgically bonded discrete sites provided by this HVOF coating process are, as a general rule, the result of particles microwelding together on impact.

This new technology is unique in several ways; the process utilizes combustion exhaust gases that are less reactive with most coating materials, hypersonic gas jet velocities provide an efficient means to impart high kinetic energy to the spray particles; moderate combustion temperatures minimize over-heating of the spray materials; and the equipment is commercially available to national and international markets for cost comparable to plasma-arc spray systems.

The thermal spray process termed detonation spray (6) utilizes the heat energy of shock waves created by exploding metered amounts of oxygen and acetylene in a device similar in design to the breech of a gun. The design and operation of the detonation gun have been described in technical literature and patent literature. This process in the U.S.A. apparently is exclusively owned by the Union Carbide Corporation.

The powder to be melted and sprayed is injected into a combustion chamber wherein a controlled detonation takes place. The following is the sequence of operation for a typical spray application: (1) injection of oxygen acetylene, and spray powder simultaneously; (2) ignition and detonation of the oxyacetylene mixture by a spark plug; and (3) purging the combustion chamber with nitrogen to prevent premature ignition of the next charge. This sequence is repeated at a rate of three to four cycles per second and is continuous until the desired coating thickness has been achieved.

The spray material is heated to a molten or semi-molten state as a result of being transported down the barrel of the detonation device by the burning gases at sonic or supersonic speeds. It is estimated that temperatures in excess of 6000° F. can be generated in this manner.

The molten or semi-molten particles of spray material impinge on the substrate at a velocity of approximately 2500 ft./sec., producing a bond that may be classified as metallurgical.

The characteristically high operating temperatures and particle velocities of the detonation spray method result in unusually high quality coatings. The higher kinetic energy of the spray particles causes more deformation on impact. These thinner particle platelets develop a finer structure and better particle interlocking. The coatings have higher densities and stronger bonds to the substrate than typical thermal spray coatings.

Recent developments in the thermal spray processing technology have resulted in similar coatings being produced by the HVOF process.

In the embodiment of the invention's method wherein the step of an electrochemical activating and metallizing follows the step of electrochemically cleaning of the metallic substrate and precedes the step of thermal spray coating, the step of electrochemical activating and metallizing is applied to the metallic surface, which has received the electrochemical cleaning, using a coating composition containing at least one metal to provide a strike coating of the at least one metal with the strike coating being an overlay coating bonded to the metallic substrate, which has received the electrochemical cleaning. For the activating and metallizing step, the electrochemically cleaned metallic surface need not be dried, but may be dried, after its distilled-water rinse for removing the aqueous cleaning solution containing acidic and/or basic substances(s), and, while dry or wet, can participate directly in the activating and electrochemical metallizing step. For the activating and metallizing step the overall procedure and equipment, except for replacement of the cleaning solution by an activator/striker solution, closely approximates those used for electrochemical cleaning. In this activating/metallizing step the metallic surface is a cathode connected to the special power supply and is rubbed by an adsorbent-wrapped graphite (or platinum) stylus connected as an anode to the power supply with an activator/strike solution being in and flowing through the graphite anode's adsorbent wrapping, while the activator/strike solution is warm and above room temperature yet below boiling temperature while in operation, with a suitable anode to cathode movement speed within the range of about 4 to 120 ft./min. and with an imposed requisite DC current density generally within the range of about 0.2 to about 10 Amp./in.$^2$ metallic surface and under a requisite voltage potential within the range of about 6 to 12 volts. The foregoing parameters of solution temperature, movement speed, current density and potential may vary somewhat falling generally within the just-mentioned ranges depending on the particularly employed composition of the metallic surface and the composition of the employed striker/activator solution. Illustrative useful movement and selective plating parameters for a variety and number of metals in selective plating solutions can be found, for example, in Table 2, page 295, of the aforementioned article entitled "Selective Plating" and incorporated by reference herein. A useful activator/strike solution composition may comprise an aqueous solution of a small amount (around 0.05 to 1.5%/wt. of strong organic acid, such as hydrochloric, sulfuric, nitric acid or the like acid and about the same small amount of a metal salt of the strong inorganic-acid with the metal of the metal salt being the metal for providing a strike coating of the at least one metal on the electrochemically cleaned metallic surface. However, after a brief period from a few seconds up to about 60 seconds of the stylus movement, the striker activator solution is replaced with a build-up solution containing about 1 to 1.4%/wt. of an organic chelate (e.g. sulfamate chelate) of the at least one metal of the striker solution and the stylus movement continued for generally a minute or more or until a desired coating thickness results. It is considered within the skill of the art to arrive at other useful activator/strike solutions and build-up solutions without undue experimentation in view of the "Selective Plating" and other art teachings.

Following the thermal spray coating of the electrochemically cleaned metallic substrate in the one embodiment of the invention's method and also in another method embodiment following the thermal spray coating of the strike coating overlaying the electrochemical cleaned metallic substrate, the resulting coated product is subjected to a post heat treatment of an elevated temperature for a time with the elevated temperature and the time effective to diffuse said metal or metals from the overlay coating deposited by thermal spray coating into the metallic substrate in the one method embodiment and into the thermochemical deposited strike coating. A typical useful post heating thermal cycle is about 1950° F. (1066° C.) to 2050° F.(1121° C.) for four hours in a vacuum or inert atmosphere furnace for a ternary Co/Cr/Al alloy coating deposited by thermal spray coating to diffuse into a Hastelloy X thermochemically cleaned metallic surface and also to diffuse into a Ni coating deposited by thermochemical metallizing and overlying the Hastelloy X thermochemically cleaned metallic surface. The art contains significant knowledge regarding diffusion bonding, including, for example, diffusion data presenting temperature ranges at which various elemental metals diffuse into other metal masses. With such art factual knowledge it is believed within the ordinary skill of the art and without undue experimentation to select and/or determine appropriate post heating thermal cycle useful temperatures and times for practicing applicant's method.

A number of advantages accrue from practice of the invention's method. Applicant's method can be practiced successfully under ambient atmospheric conditions and without resorting to protective atmospheres, vacuum and without employing a controlled atmospheric chamber. In comparison customarily thermal spray coating techniques and systems involving deposition without a protective atmosphere or vacuum, or outside of, rather than within, a controlled atmosphere chamber, or not involving the use of self-fluxing, invariably result in the deposited thermal spray coating lacking metallurgical bonding and lacking metal diffusion at the deposited coatings interface, whether or not the deposited coating is subjected to a post heat treatment to instigate and/or provide metal diffusion at the deposited coating's interface. In contrast by the invention's method always including a prior thermochemical cleaning step and a subsequent post heat treating, the thermal spray coating deposits by the invention's methods invariably exhibits metallurgical bonding and, after the post heat treating, invariably presents evidence of intermetallic diffusion at the deposited coating's interface. It is believed to be accepted that metallurgical bonding accompanied by intermetallic diffusion at the bond interface is significant evidence of advantageous bonds of superior integrity and bond strength with bond strength test measurements from examples, which follow, supporting this position.

To further support the noticeable extraordinary bond strength resulting from practices of applicant's method invention one has only to compare bond strengths reported in examples, which follow, with what are believed to be typical literature-reported bond strengths for coatings produced via the plasma spray process and probably under atmospheric conditions as shown in Table II, which follows:

TABLE II

| Coating Material | Aluminum | Aluminum Bronze | Low Carbon Steel | Stainless Steel | K-500 Monel |
|---|---|---|---|---|---|
| BOND STRENGTH FOR SUBSTRATE MATERIALS INDICATED, PSI | | | | | |
| $87TiO_2—13Al_2O_3$ | 3895 | 4175 | 4105 | 4165 | 4150 |
| $Cr_2O$ | 5965 | 6220 | 6485 | 6450 | 6345 |
| 95.5Ni—4.5Al | 4430 | 4725 | 4880 | 4885 | 4800 |
| Ni—20Cr | 4310 | 4350 | 4455 | 4485 | 4541 |
| Molybdenum, 99% | 5075 | 5730 | 5920 | 5810 | 5745 |
| Aluminum, 99.0+% | 3965 | 4465 | 4405 | 4285 | 4270 |
| Aluminum Bronze | 4085 | 4555 | 4670 | 4755 | 4715 |
| SURFACE ROUGHNESS OF SUBSTRATE, MICROINCH AA | | | | | |
| | 300 | 260 | 250 | 220 | 250 |

NOTE:
The bond tensile strength test were conducted in accordance with ASTM-633 specification requirements.
a. Bond tensile strengths are averages for six determinations.
Source material (A Plasma Flame Spray Handbook, Naval Sea System Command) March 1977

The examples, which follow, provide laboratory practices illustrative of full scale practices and demonstrating significant advantages of the invention, with the numbered examples being examples of the invention and with the lettered examples being examples omitting critical procedural element(s) of the invention and serving to provide control and comparison examples so that advantages of the invention, such as resulting significantly greater bond strength by the method of the invention, will be readily apparent. A preferred and best mode of the invention is illustrated by Example 2.

EXAMPLE 1

Providing Metallic Substrate

Commercially available Hastelloy X alloy was employed in this Example 1 and also in Example 2, as well as in comparison Example A. Commercially available Hastelloy X is a nickel-base alloy containing significant amounts of Cr, Mo and Fe and comprises: Co—0.5 to 2.5%, Cr—20.5 to 23%, Mo—8 to 10%, W—0.2 to 1%, Fe—17 to 20%, C—0.05 to 0.15 or 0.2, up to 1% of Si and Mn, and balance Ni. The commercially available plate visibly appeared to be superficially clean, i.e. free of any surface protective paint, coating, or the like and free of defects, stains, scratches, gouges, etc. A plurality of test buttons, each 0.250 inch thick by one inch diameter, were machined from a Hastelloy X rod with the button's metallic surface for subsequent processing and coating. The evaluated button's metallic surface, evaluated by a conventional smoothness profilometer, was a mill surface finish measurement approximating 20 microinches. Although the buttons appeared to be superficially clean and apparently free of oil and/or grease, the buttons were precleaned by immersing in a liquid both of degreasing solvent of trichlorethylenel-1,1,1 and upon removal from the bath dried in warm, clean air at about 150° F. (65.6° C.). Following degreasing each button was affixed (i.e. electric arc-welded) to an appropriate metal fixture for further processing through electrochemical cleaning and coating procedural steps as well as a heat treating step. The fixture also was suitable for use in measuring bond adhesion strengths.

Electrochemical Cleaning

Using procedures, techniques, and apparatus conventionally employed in selective plating (also termed electrochemical metallizing), the metallic surface of the affixed buttons were electrochemically cleaned using a commercially available hand-held stylus and an appropriate electrocleaning solution. The hand-held stylus comprised a pre-purified, high-density graphite anode, which was wrapped with an adsorbent material (e.g. cotton batting or felt), and had an insulated handle extending therefrom. Employing direct current power pack equipment conventional for electrochemical cleaning and metallizing, fixture-affixed buttons of the Hastelloy X alloy were electrically connected as a cathode to the graphite anode of the stylus. A plurality of the buttons then had their metallic surface electrochemically cleaned. The button's exposed metallic surface was electrochemically cleaned by gently rubbing the surface by the hand-held stylus with a back and forth movement at a carbon anode to button cathode speed of 15 to 25 linear ft./min. under a current density of 0.02 to 0.03 ampere-hour/in.$^2$ of surface and a voltage range of +9 to +11 volts and with a flowing over the button's metallic surface and intermediate the graphite anode of the stylus of an electrochemical aqueous cleaning solution at an operating temperature of 125°-140° F. (51.7°-60° C.). The cleaning solution consisted essentially of 4½ oz. of sodium hydroxide/gal. and 1 oz. of citric acid/gal. in 1 gallon of distilled water. After several passes of the stylus back and forth, flow of the electrochemical cleaning solution was stopped and the buttons thoroughly rinsed with distilled water.

Thermal Spray Coating

In this example, there was used the thermal spray coating commonly termed a High Velocity Oxygen Fuel (HVOF) process with utilization of a system known as Metco Diamond Jet and with employment particularly of the DJ Diamond Jet Gun. The employed jet gun was air-cooled, although a water-cooled gun or device also could be used. The art-known jet gun (not illustrated herein) included a housing and various components providing inlet ports and channels leading towards the gun's nozzle, with all components together permitting introduction and flow towards the nozzle of compressed air (which flowing compressed air served to cool the gun and upon exiting providing an air envelope surrounding an exhaust stream emerging from the gun nozzle), a fuel or flammable gas (e.g. oxygen-propylene mixture or oxygen-hydrogen mixture) which provided the exhaust stream, a coating composition, containing a metallic powder, in a carrier gas of argon (alternatively one may use another inert gas such as nitrogen, helium, or the like) etc.

During operation and within the gun and near the nozzle, the fuel or flammable gas under pressure burned to produce a hot, high velocity jet exhaust stream, which exits from the gun's nozzle, while a coating composition powder was introduced axially and centrally into the exhaust gas stream of the fuel gases so as to be heated and to melt near the nozzle and to be completely surrounded by the exiting exhaust gas stream over a distance of up to 13 inches or more outwardly from the nozzle while being further heated uniformly and accelerated. Particle velocities of the melted powder reached in excess of 2,500 ft./sec. at impact upon a target of the metallic Hastelloy X buttons welded to the fixtures. The impact of the particles caused the molten particles to adhere and to deform and coalesce into any available pore sites on the metallic surface of the Hastelloy X buttons. The kinetic energy and momentum being transferred upon impact produced a high degree of compressive strength within the HVOF applied coating with the hot, extremely high velocity particles bonding exceptionally well to the metallic surface being coated and typically providing a high integrity mechanical/metallurgical structures. Metallurgically bonded sites within the applied HVOF coating at this stage of the method generally were the result of various particles microwelding together upon impact.

In the example, the introduced metallic powder particles of the coating composition were of a nominal −44 to +10 micron size range and were of a composition consisting essentially of 67%/wt. cobalt, 28%/wt. chromium and 5%/wt. aluminum. The employed carrier gas for the powder particles was argon under a pressure of 125 psi and at a flow of 55, with an "E" pick-up shaft and a 20 psi air vibrator setting with the last three mentioned parameters being settings particular to and employed with the customary conventional powder feeder ordinarily employed with the art-available DJ Diamond Jet Gun.

As to the employed DJ Diamond Jet Gun, there was employed its siphon plug 3, nozzle shell B, nozzle insert 5, air cap 4 and powder injector 5.

Parameters for the employed air and oxygen/hydrogen fuel or flammable gas were: oxygen pressure, 150 psi; oxygen flow, 38 FMR; oxygen, SCFH, 550; hydrogen pressure, 125 psi; hydrogen flow, 125 FMR; hydrogen, SCFH 1400; air pressure, 75 psi; air flow, 45 FMR; and air, SCFH, 710.

The thermal spraying was with a distance of 6 inches between the target of degreased Hastelloy X buttons and the nozzle of the DJ Diamond Jet Gun and at a spray rate of 2 lbs/hr. with an observed deposit efficiency of about 70%/wt. The thermal spraying was with the center of the exhaust jet directed at or about the center of the button's metallic surface for a time sufficient to deposit a coating at least about 0.008 in. thick.

Heat Treating

Upon completion of the thermal spraying to provide a thermally sprayed coating of a desired coating thickness, generally about 0.008 inch on the surface of the Hastelloy X buttons, the thermally spray coated buttons were heat treated in a vacuum furnace at 1950° F. (~1066° C.) for 4 hours. This heat treatment cycle ordinarily permits a conventionally applied metallic overlay coating to diffuse into a metallic substrate surface and to metallurgically bond thereto.

Bond tensile adhesion testing was then conducted in accordance with the procedure set forth in ASTM C633-79 specification on Hastelloy X buttons overlaid with the HVOF deposited 68-Co/28-Cr/5-Al coating.

Adhesion and Bond Strength Testing

Unless stated otherwise, bond tensile adhesion testing in all examples was conducted in accordance with ASTM C633-79 specification. Test specimens (bond caps) used for this ASTM test are nominally one inch diameter cylinders, although for the examples herein smaller buttons are used with measured values adjusted accordingly. One end is counterbored and threaded for attachment to the loading fixture, the other is ground or machined perpendicular to the axis of the cylinder. The finished end is prepared for coatings using the same method intended for the process being tested. The bond cap or test button is then coated to a predetermined thickness with the selected coating material. This coated sample is then cemented to the machined or ground end of a blank bond cap. Structural adhesives, such as heat-cured epoxy resins, having 10,000 PSI or greater adhesive bonding strengths are used for this purpose.

The cemented bond caps are pulled in a tensile testing machine at a controlled crosshead speed of 0.050"/min. and the ultimate strength recorded. Generally, sets of up to seven identical bond caps are tested to obtain an average bond strength per area of bonded surface.

EXAMPLE 2

Providing Metallic Substrate and Electrochemical Cleaning

The procedures just-described in Example 1 were followed for the steps of: providing the metallic substrate of Hastelloy X buttons, in a condition, which was superficially clean and was degreased and which had been affixed to an appropriate fixture; and thereafter was electrochemically cleaned.

Following the thorough water rinsing of electrochemically cleaned metallic surface of a Hastelloy X button, a plurality of such processed buttons further were processed as follows:

Electrochemical Metallizing

Employing the hand-held stylus, as employed in the electrochemical cleaning, except that the stylus before using was thoroughly rinsed with distilled water, the electrochemically cleaned metallic surfaces of a plurality of the fixture-affixed Hastelloy X buttons were surface activated to enhance bonding and then subsequently electrochemically metallized by placing a deposit of nickel thereon.

With the fixture-affixed buttons electrically connected as a cathode to the graphite anode of the stylus, the stylus was gently rubbed over the electrochemically cleaned metallic surface of the button with a back-and-forth movement at an anode to cathode speed of 15 to 25 linear ft./min. under a current density of 0.035 to 0.045 ampere-hour/in.$^2$ of surface and a voltage range of 9 to 11 volts with a flowing over the button's metallic surface and intermediate the graphite anode and the metallic surface at an operating temperature of about 125° to 140° F. (51.7° to 60° C.) of a nickel-strike activating solution consisting essentially of 4 to 8 oz. nickel chloride/gal., 4 to 8 oz. hydrochloric acid/gal., and 1 gallon of distilled water. Following about 6 to 8 back-and-forth movement cycles of the stylus, the flow of the activator solution was ceased and without water rinsing, replaced by a nickel metallizing solution consisting essentially of 70 to 80 oz. nickel sulfamate/gal., boric acid in an amount to saturate the solution, 1 to 3 drops ammonium hydroxide/gal., and 1 gallon of water. The back-and-forth stylus movement was continued at anode to cathode speed of 40 to 80 linear feet per minute with the nickel metallizing solution at an operating temperature of 125° to 140° F. (51.7° to 60° C.) under a current density of 10 amps./in.$^2$ anode surface and a voltage of between 8 to 16 volts and with nickel depositing at a 0.0005 in. thickness/minute over 100% of the metallic surface of the Hastelloy X buttons. After an elapsed time of electrochemical metallizing providing a nickel deposit of desired thickness, generally 0.0005in., the electrochemical metallizing procedure was stopped and the nickel-coated button surfaces were thoroughly rinsed with distilled water and permitted to air dry.

Thermal Spray Coating

Thereafter a plurality of these electrochemically nickel-coated buttons were subjected to thermal spray coating by the same procedure and under conditions just-described in Example 1, i.e. HVOF thermal spray process employing the −44 to +10 microns powder particle composition of 67%/wt. Co, 28%/wt. Cr, and 5%/wt. Al, until there was deposited an overlay coating of about 0.0007 in. thickness.

Heat Treating

Upon completion of the thermal spray coating, a plurality of the thermally spray-coated buttons were subjected to heat treating by the same procedure and conditions just-described in Example 1, i.e. vacuum furnace, 1950° F. (1066° C.) for four hours.

Providing Metallic Substrate

The procedure just-described in Example 1 was followed to provide the metallic substrate of Hastelloy X buttons affixed to appropriate metal fixtures for further processing with the affixed buttons having an exposed metallic surface, which surface presented for coating the as-received mill finish which was superficially clean and had been degreased.

No electrochemical cleaning and no electrochemical metallizing were made of this metallic surface before proceeding with thermal spray coating.

Thermal Spray Coating

The superficially clean and degreased metallic surface of the Hastelloy X buttons affixed to the fixture were thermal spray coated by the same procedure and conditions just-described in Example 1, i.e. HVOF thermal spray process employing the −44 to +10 micron powder particle composition of 67%/wt. Co, 28%/wt. Cr, and 5%/wt. Al until there was deposited a coating of about 0.009 in. thickness.

Heat Treating

Upon completion of the thermal spray coating, a plurality of the thermal spray-coated buttons were subjected to heat treating by the same procedure and conditions just-described in Example 1, i.e. vacuum furnace, 1950° F. (1066° C.) for four hours.

Thereafter, bond tensile adhesion testing measurements, according to ASTM C633-79 specification, were made on the buttons of Hastelloy X overlaid with the HVOF deposited coating.

Results of bond tensile adhesion testing measurements, made according to ASTM C633-79 specification, for the prepared HVOF coated Hastelloy X button products of Examples 1, 2 and A are presented in the following Table III.

TABLE III

| Example | Product Sample No. | Metallic Surface Preparation Before HVOF Depositing | HVOF-Deposited Coating Thickness (inches) | Measured Bond Strength (psi) | Observed Failure Mode* |
|---|---|---|---|---|---|
| A | 6 | superficially clean | 0.009 | <100 | interface |
| | 7 | plus degreasing | 0.009 | <200 | interface |
| | 8 | | 0.009 | 2012 | interface |
| 1 | 1 | superficially clean | 0.008 | 10,217 | epoxy |
| | 2 | plus degreasing plus thermochemical cleaning | 0.008 | 9,529 | epoxy |
| 2 | 3 | superficially clean | 0.007 | 10,369 | epoxy |
| | 4 | plus degreasing plus | 0.007 | 11,210 | epoxy |
| | 5 | thermochemical cleaning plus thermochemical metallizing | 0.007 | 10,675 | epoxy |

*Failure mode: interface = test failure for Ex. 1 samples at interface of the Hastelloy X metallic surface and the HVOF-deposited Co/Cr/Al overlay coating and test failure for Ex. 2 samples at interface of HVOF deposited Co/Cr/Al overlay coating with the electrochemically deposited Ni;
epoxy = test failure in the epoxy cement bonding the HVOF-coating to the blank bond cap held and pulled by the tensile testing apparatus according to ASTM C633-79.

Thereafter bond tensile adhesion testing was made by the procedure of ASTM C633-79 specification of the resulting Hastelloy X button's metallic surface overlaid with a thermally deposited and heat treated coating from the Co/Cr/Al powder composition.

EXAMPLE A

This is a comparison or control example omitting critical procedural steps or elements of the overall process of the invention.

Additional evaluations were made of sample products resulting from Examples 1, 2 and A.

Qualitative X-ray analyses were made of the −44 to +10 micron range powder coating composition employed for depositing a HVOF thermally sprayed coating according to Examples 1, 2 and A, as well as for a typical resulting, as-deposited, coating (Product Sample 1) by the HVOF thermally sprayed coating process. Upon comparison within the limits of the analyses there appeared to be no significant elemental compositional change between the employed 67%/wt. Co, 28%/wt. Cr, and 5%/wt. Al powder coating composition and the HVOF typically resulting as-deposited coating. For each of the qualitative X-ray analyses plots (not presented herein), of peaks for Al, Cr and Co occurred at about the same energy (KEV) and appeared to be of about the same intensity.

Products of each of Examples 1, 2 and A were sectioned with a high speed diamond cutoff wheel and cold epoxy mounted. Grinding and polishing operations were performed exclusively with diamond slurries on lapping wheels and nylon cloths to minimize smearing and particle pullout. The metallographic samples were examined utilizing a Nikon Epiphot Inverted Metallograph for interfacial traces of diffusion.

Samples were evaluated utilizing an AMRAY 1000 high resolution scanning electron microscope capable of resolving 70A° (7nm). The Scanning Electron Microscope (SEM) in conjunction with either Energy Dispersive X-Ray (EDS) Analysis or Wavelength Dispersive X-Ray provide very powerful tools for analysis of metals, ceramics, and other materials. The EDS equipment is a computer-based system having a DEC 11/23 high performance processor with a 256 Kb memory. A 32 Mb Winchester Hard Disk and 1.2 Mb floppy disk drive enhance data access and storage. An ultra-high resolution color monitor provides extensive full screen alphanumerics and various peak labelling formats. X-Rays emitted from various regions of the microstructure are collected and analyzed by the PGT system according to energy and intensity. Results may be displayed in the following formats:

X-Ray Spectra

Displays intensity versus energy for sample region of interest. This region may vary in size from about 1 cm square to a spot size of 0.2 microns in diameter. The spectra identify the elements present and their approximate amount. Up to four spectra may be displayed simultaneously. Complete identification of peaks is provided by a sophisticated automatic identification program. All files may be stored to disk for later recall and may be hard copied using an Epson Fx-86e graphics plotter/printer.

X-Ray Maps

Digital color dot maps for up to six elements can simultaneously be collected by the PGT System. Display of the maps on the analyzer monitor is possible in two modes, either as a single element with colors used to designate intensity or two element display with a unique color for each of the elements. A direct readout of the area fraction of a particular element can easily be obtained from the data. Regions in the microstructure where the two elements co-exist are displayed as separate color to show possible reaction zones. The digital dot maps are easily transferred to the SEM CRT for high resolution gray-scale photography. The resultant image can then be directly compared with the secondary electron image from the spectra so that regions rich in a particular element can be directly compared to the microstructure. In addition, horizontal or vertical line profiles can be easily extracted from the digital dot maps.

Line Profile Analysis

Horizontal Digital Line Profile Analysis of up to 12 elements simultaneously is also directly available. This procedure provides quantitative intensity data on the distribution of specific elements along a line in the specimen. Line profile analysis can be used, for example, in studies of corrosion reactions, segregation in welds and castings or in measurement of diffusion coefficients.

The Peak FOCUS WDS equipment uses four crystals to diffract the X-Rays into a flow proportional counter for detection of the elements B, C, N, O, and F. The positioning of the crystals is done by computer control from the PGT System 4 Plus and the resulting data can be displayed as either a spectrum, a digital dot map, or a line profile. Information so displayed can be useful in studies of the distribution of carbides in an alloy, boron levels in glass samples, carbon profiles in carburized/-decarburized steels, or oxide scales.

Metallographic and image analysis photomicrographs of the as-sprayed HVOF thermally deposited coatings and of the HVOF thermally deposited coatings after heat treating for Examples 1, 2 and A under 1000× magnification showed both the as-deposited and the as-deposited/heat treated coatings were close to theoretical density with less than 2% porosity as measured by quantitative image analysis.

Photomicrographic examination of the product of Example A (i.e. processed directly from degreasing to HVOF thermal depositing plus heat treating) showed that the interface between the degreased metallic surface and the HVOF deposited overlay coating was very sharp and distinct with no apparent visual evidence of any metallurgical reaction at the interface. A slight contamination zone or oxide layer appeared to be present at the substrate/coating interface boundary with this more readily apparent at higher magnifications, especially 2000× and higher.

Photomicrographic examination of the interfacial boundary of the substrate to HVOF-deposited coating for products of Examples 1 and 2 for each showed an essentially homogeneous microstructure across their apparent original joint interface, especially apparent at 5000× magnification. For Example 2 products there appeared to be slightly greater interaction between the HVOF-deposited coating and the electrochemically metallizing deposited coating than for Example 1 wherein the HVOF-deposited coating was applied directly to the electrochemically cleaned metallic surface.

EXAMPLE 3

Examples 1 and 2 are repeated with the same materials, procedures and parameters, except that during their electrochemical cleaning step the fixture-affixed Hastelloy X alloy buttons are electrically connected first as the anode with the graphite of the stylus connected as the cathode for several passes back and forth of the stylus. Thereafter, the polarity is reversed with the buttons being connected as the cathode and the graphite being the anode with an additional several back and forth passes being made.

For a first set of such electrochemically cleaned button's metallic surface, as in Example 1, there follows the thermal spray coating and heat treating steps. As in Example 2, for a second set of such electrochemically cleaned button's metallic surface there follows the Example 2's electrochemical metallizing and then the thermal spray coating and heat treating steps.

The products of each of this Example's sets of Hastelloy X buttons overlaid with the HVOF deposited Co/Cr/Al coating, after their subsequent heat treating step, then are subjected to the aforedescribed ASTM adhesion bond strength testing. The bond strengths for the resulting products of each of the first and second sets approximate the measured bond strength values (psi) reported in Table 1 for Examples 1 and 2 respectively and are of a mean average bond strength of about 10,000 psi with observed failure mode invariably upon bond testing being in the epoxy adhered to the HVOF deposited Co/Cr/Al overlay coating for each of the first and the second sets of products.

Metallurgical diffusion of the Co/Cr/Al overlay coating is present in the products of each of this Example's sets of Hastelloy X buttons overlaid with the HVOF-deposited Co/Cr/Al overlay coating with in the first set (i.e. those products after this Example's electrochemical cleaning, processed according to subsequent Example 1's steps) the metallurgical diffusion being into the underlying metallic surface of Hastelloy X, and in the second set (i.e. those products after this Example's electrochemical cleaning, processed according to subsequent Example 2's steps) the metallurgical diffusion being into the underlying Ni overlay coating deposited by eleotrochemical metallizing.

EXAMPLE 4

Examples 1 and 2 are repeated with the same materials, procedures, parameters, etc. as in Examples 1 and 2, except that the electrochemical cleaning step is replaced by a plating tank system of electrochemical cleaning as follows:

Following the degreasing of the Hastelloy X alloy buttons and their affixing to the appropriate metal fixture for further processing, a plurality of the fixture-affixed buttons are electrochemically cleaned by immersing in a mechanical agitated acidic solution contained in a tank ordinarily used for conventional tank plating. The agitated acidic solution consists essentially of a 70% by wt. sulfuric acid aqueous solution. The degreased metallic surface of the Hastelloy X buttons are electrically connected as the cathode to a direct current power source to an anode of carbon, also immersed in the agitated aqueous sulfuric acid solution, at a cathode to anode distance approximating six inches therebetween and with a voltage of 10 volts while a current density of 6 ampere-hour/in.$^2$ of metallic surface is imposed for several minutes.

Thereafter, a plurality of these tank electrochemically cleaned buttons are thoroughly rinsed with distilled water and dried, and; as in Example 1, then are thermally spray coated by the HVOF process with a Cr/Co/Al overlay coating which is heat treated, and with bond tensile strength measurements, as described earlier, then being made of the HVOF-deposited Cr/Co/Al overlay coating to the electrochemical cleaned metallic surface of the Hastelloy X buttons. The bond strengths (mean average) for these products exceed 10,000 psi. The test-observed bond strength failure mode invariably is observed in the epoxy adhering to the Co/Cr/Al overlay coating.

An additional plurality of these tank electrochemically cleaned buttons are thoroughly rinsed with distilled water and without drying then are processed, as in Example 2, through the steps: of electrochemical metallizing, including the metal-strike activating solution and the nickel metallizing solution, to provide a nickel overlay coating on the metallic surface of the Hastelloy X button; of thermal spray coating by the HVOF process to provide an overlay Co/Cr/Al coating; and of heat treating in a vacuum furnace at 1950° F. (1066° C.) for about four hours. Bond strength measurements are made for these products with the mean average bond strengths exceeding 10,000 psi and an observed bond strength failure mode invariably in the epoxy adhering to the Co/Cr/Al overlay coating.

For the foregoing sets of products of this Example, there is noted metallurgical diffusion of the Co/Cr/Al overlay coating, at its interface therewith, into the metallic surface of Hastelloy X (for those products processed alike Ex. 1 after the tank electrochemical cleaning) and, at its interface therewith, into the electrochemically deposited Ni overlay coating (for those products processed alike Example 2 after the tank electrochemical cleaning).

EXAMPLE 5

The procedure of Example 2 is repeated and followed in general, except as noted below:

In place of the Example 1's buttons of Hastelloy X this example employs small 0.250 in. thick by 1.0 in. diameter buttons of a low carbon steel (1018-1020), whose metallic surface for subsequent coating is in a superficially clean state with degreasing, rinsing and drying completed just prior to proceeding to an electrochemical cleaning of the metallic surface.

Electrochemical Cleaning

The one-inch diameter metallic surface of a plurality of the low carbon steel buttons is electrochemically cleaned by the same procedures, techniques and apparatus as used in Example 1 except that the cleaning solution consists essentially of 15%/wt. sulfuric acid, 60%/wt. phosphoric acid, 10%/wt. chromic acid and balance water, and during the cleaning is at about 125° F. (51.7° C.). In the electrochemical cleaning the buttons are connected as the cathode with employing of a current density of 6.5 ampere-hour/in$^2$ and a voltage range of +12 to +14 volts for several minutes.

Electrochemical Metallization

The same solutions, procedures, and equipment as employed in Example 2 for electrochemical metallization are used in this example, and the plurality of just-cleaned low carbon steel buttons are processed accordingly with stylus movement for a time required to provide about a 0.0005 in. thick nickel strike coating on the metallic surface of the plurality of the low carbon steel buttons just-previously electrochemically cleaned.

Thermal Spray Coating

For the thermal spray coating step in this example there is used an atmospheric plasma spray coating process. By atmospheric it is intended to convey that the spray process is conducted outside of any enclosed chamber and at normal ambient conditions and in the normal atmosphere, except for specific gases and fluids required for operation of a typical commercially available plasma-arc spray gun. The coating composition is type 420 stainless steel as a powder of −74 to +44 μm size and of a composition consisting essentially of iron having a 0.35%/wt. C, 0.02%/wt. P, 0.02%/wt. S, 0.5%/wt. Mn, 13.0%/wt. Cr, 0.5%/wt. Si content. For gun operation there are used nitrogen gas for the plasma gas with a type G (Metco) nozzle at 500 amps. current and 75 volts with a powder spray rate of about 7 lbs./hr. The spray distance is 4 to 7 inches and the substrate temperature is more than 250° F. (121° C.) during coating deposition with the plasma-arc spraying continued until the deposited coating approximated 0.015 in. thickness.

Heat Treatment

Upon completion of the thermal spray coating, the thermally spray coated buttons are heated under a nitrogen atmosphere in a heat-treating furnace at about 1650° F. (899° C.) to 1800° F. (982° C.) for two hours.

Bond tensile adhesion testing on these heat-treated buttons provides a coating average bond strength in excess of 10,000 psi with the failure mode in the epoxy. A comparison coating average bond strength does not exceed 1000 psi upon practice of the corresponding process of Example 5 with omission of the electrochemical cleaning and electrochemical metallization steps to provide the coated buttons for comparison. The comparison buttons also do not show evidence of any noticeable intermetallic diffusion at their coating interface. While in contrast, the buttons coated according to Example 5 do exhibit significant intermetallic diffusion at their coating interface.

While certain preferred embodiments of the present invention have been disclosed in detail, it is to be understood that various modifications may be adopted without departing from the spirit of the invention or scope of the following claims.

I claim:

1. A method for providing a metallurgically bonded thermally sprayed coating comprising:

a) electrochemically cleaning a superficially clean and degreased metallic surface of a workpiece to be coated;

b) thermal spray coating of the metallic surface, which has received said electrochemical cleaning, with a coating composition containing a metal or metals to provide on said metallic surface an overlay coating of said metal or metals; and c) post heat treating at an elevated temperature and for a time with said elevated temperature and said time effective to diffuse said metal or metals into said metallic surface.

2. The method of claim 1 in which in a) the electrochemical cleaning includes employing a preparatory aqueous solution containing an acidic- or alkaline-soluble substance or both with the metallic surface in cathodic connection to a moving movable anode and with the preparatory aqueous solution between the metallic surface and the movable anode.

3. The method of claim 2 in which in b) the thermally sprayed coating is a Co/Cr/Al composition deposited on a workpiece of a nickel-base alloy containing Cr, Mo and Fe.

4. The method of claim 1 in which in a) the electrochemical cleaning is carried forth with the metallic surface immersed in a preparatory aqueous solution contained in a tank and which preparatory aqueous solution is a useful electrochemical brightening agent for the metallic surface.

5. The method of claim 1 in which in b) the thermal spray coating is carried forth by practice of a High Velocity Oxygen Fuel Spray coating process which comprises introducing powder particles of the coating composition into an exhaust jet stream from a pressurized burning of a fuel gas so as to accelerate and heat the powder particles to provide the thermal spray coating of said metallic surface.

6. The method of claim 1 in which in b) the thermal spray coating is carried forth by practice of an atmospheric plasma spray coating process.

7. The method of claim 1 in which in b) the thermal spray coating is carried forth by practice of a wire or powder flame spray coating process.

8. The method of claim 1 in which in b) the thermal spray coating is carried forth by practice of an electric arc spray coating process.

9. The method of claim 1 in which in b) the thermal spray coating is carried forth by practice of a detonation spray coating process.

10. A method for providing a metallurgically bonded thermally sprayed coating comprising:

a) electrochemically cleaning a superficially clean and degreased metallic surface of a workpiece to be coated;

b) electrochemically activating and metallizing the metallic surface, which has received the electrochemical cleaning, with a coating composition containing at least one metal to provide a strike coating of the at least one metal;

c) thermal spray coating of the strike coating with a coating composition containing a metal or metals to provide an overlay coating of the metal or metals on the strike coating; and d) post heat treating at an elevated temperature and time with said elevated temperature and said time effective to diffuse said metal or metals into said strike coating.

11. The method of claim 10 in which:

in a) the metallic surface of the workpiece is a nickel-base alloy containing Cr, Mo and Fe;

in b) the strike coating comprises nickel; and in c) the thermal spray coating is carried forth by practice of a High Velocity Oxygen Fuel Spray coating process, which comprises introducing powder particles of the coating composition into an exhaust jet stream from a pressurized burning of a fuel gas so as to accelerate and heat the powder particles to provide the thermal spray coating of the strike coating, and the overlay coating is a Co/Cr/Al composition.

* * * * *